US011802027B2

(12) United States Patent
Szymanowski

(10) Patent No.: US 11,802,027 B2
(45) Date of Patent: Oct. 31, 2023

(54) HOIST SYSTEM

(71) Applicant: Philbilt LLC, Pipersville, PA (US)

(72) Inventor: Phillip Szymanowski, Pipersville, PA (US)

(73) Assignee: Philbilt LLC, Pipersville, PA (US)

( * ) Notice: Subject to any disclaimer, the term of this patent is extended or adjusted under 35 U.S.C. 154(b) by 0 days.

(21) Appl. No.: 17/704,634

(22) Filed: Mar. 25, 2022

(65) Prior Publication Data

US 2023/0303367 A1 Sep. 28, 2023

(51) Int. Cl.
*B66C 23/44* (2006.01)
*B66C 23/78* (2006.01)

(52) U.S. Cl.
CPC ..... *B66C 23/44* (2013.01); *B66C 23/78* (2013.01)

(58) Field of Classification Search
CPC ..... B66C 23/44; B60P 1/5471; B60P 1/5476
See application file for complete search history.

(56) References Cited

U.S. PATENT DOCUMENTS 2,425,663 A * 8/1947 Wooldridge ..... B66C 23/36 212/258
3,780,878 A * 12/1973 Morrow ..... B66C 23/36 212/306
3,933,250 A * 1/1976 Roberts ..... B66C 23/78 212/226
3,980,276 A * 9/1976 Burkland ..... B60P 1/5476 D34/34
5,480,041 A * 1/1996 Turner ..... B66C 23/36 212/293
5,992,655 A * 11/1999 Greenberg ..... B66C 13/56 212/281
6,217,044 B1 * 4/2001 Beeche ..... B62D 7/1509 280/43.24
6,609,622 B2 * 8/2003 Forsyth ..... B66C 23/44 212/258
7,029,019 B1 * 4/2006 Dye ..... B60D 1/06 280/416.2
8,684,197 B2 * 4/2014 Pech ..... B66C 23/348 212/300
8,851,823 B1 * 10/2014 Hallmon, Jr. ..... B66C 23/44 414/546
9,963,329 B1 * 5/2018 Guess, Jr. ..... B60P 1/04
10,221,049 B1 * 3/2019 Horton ..... B66F 9/065
2004/0033109 A1 * 2/2004 Gelmi ..... B66C 23/44 405/174
2007/0045211 A1 * 3/2007 Beatty ..... B66C 23/44 212/180
2016/0167933 A1 * 6/2016 Birch ..... B66C 23/44 254/326
2020/0385246 A1 * 12/2020 Dunn ..... B66C 23/44

* cited by examiner

*Primary Examiner* — Michael R Mansen
*Assistant Examiner* — Juan J Campos, Jr.

(57) ABSTRACT

Provided is a hoist arm structure having top and bottom ends, and an attachment element to releasable attach the bottom end of the hoist arm structure to an attachment location of a utility vehicle whereby the hoist arm is able to pivot relative to said attachment location, the hoist system further comprising an adjustment winch having an adjustment cable extending therefrom with adjustment cable having a distal end opposite the crank, and such distal and adjustment winch adapted for securing to respective structural elements of a structural frame system, wherein such structural elements are located on opposite lateral side of the utility vehicle.

15 Claims, 5 Drawing Sheets

HOIST SYSTEM

FIELD OF THE INVENTION

The invention relates to a hoist system releasably attachable to a utility vehicle.

BACKGROUND OF THE INVENTION

Small utility vehicles such as utility task vehicles ("UTVs") also known as "side-by-sides" or "SXSs" and to a certain extent smaller all-terrain vehicle ("ATVs") also known as "quads" or "four wheelers" and other similar equipment have traditionally been used to haul equipment and supplies in locations that make using a pickup and flatbed truck impractical or impossible, e.g., forests or narrow paths and uneven ground locations. In particular, conventional UTVs have onboard storage space for moving such equipment and supplies, and receiver mounts, typically, located in the front and/or back for attaching tools for performing work including, for example, a snow plow for the front receiver mount, and a grass cutter or seeder for the rear receiver mount.

For hauling large objects such as tree cut limbs and trunks, or rocks and boulders, conventional UTVs require external equipment, such as a portable hoist or hoist to lift such items for placement in onboard storage beds of the UTVs. Such external equipment tends to be heavy and such methods are very time consuming for moving such objects relatively short distances, e.g., less than several hundred yards. Certain conventional hoist or hoist configurations allow the lifting of relatively light weight loads by mounting fixed angle hoists to luggage racks on the front or rear hoods of UTV including designs disclosed in U.S. Pat. Nos. 7,575,120, and 7,156,246, which are incorporated by reference herein. Although such systems allow the lifting and moving of objects without need to locate such objects in storage beds of UTVs, they are limited to lifting relatively light objects due to the attachment locations and fixed angle hoist arms.

There is a need for a compact, storable hoist system of a design and configuration that enables greater flexibility and the lifting of substantially heavier objects than conventional designs.

SUMMARY OF THE INVENTION

The present invention solves the problems of the limitations of current UTV hoist designs by employing a configuration of a light-weight, portable and stowable hoist system configured for releasable attachment to an attachment location of a utility vehicle, such as a UTV, that takes advantage of such utility vehicles weight distribution and provides an advantageous system for changing the hoist arm angle for lifting and transporting objects of greater weight than conventional hoist designs.

In one embodiment, such advantageous hoist system comprises a hoist arm structure having top and bottom ends, and an attachment element to releasable attach the bottom end of the hoist arm structure to an attachment location of the utility vehicle whereby the hoist arm is able to pivot relative to said attachment location. Such hoist system further comprises an adjustment winch having an adjustment cable extending therefrom with adjustment cable having a distal end opposite the crank, and such distal adapted for releasable attachment to a location of a first structural element on a first lateral side of the utility vehicle, wherein the adjustment winch is adapted for securing to a location of a second structural element on a second lateral side of the utility vehicle opposite said first lateral side. The hoist system also includes a first pulley rotatably mounted to a first location proximate the top end of the hoist arm structure and adapted to receive the adjustment cable, and a second pulley rotatably mounted to a second location proximate the top of the hoist arm structure for receiving a hoist cable, said hoist cable having a distal end for coupling to an object to be lifted.

In operation of such hoist system embodiment, the adjustment winch may be operated to extend a relative portion of the adjustment cable thereby pivotally lowering the hoist arm structure relative to the attachment location, or the adjustment winch may be operated to retract the adjustment cable thereby pivotally raising the hoist arm structure relative to the attachment location. By such operation in conjunction with extending or retracting the hoist cable when coupled to the object, the hoist may advantageously lift the object and locate it relatively closer to the center of gravity of the utility vehicle to enable loads of greater weight to be transported than in conventional designs.

A hoist winch for extending and retracting the hoist cable may be part of the hoist system or located separately, such as a winch built-in the utility vehicle proximate the attachment location. The adjustment winch and hoist winch may be manual winches with respective hand cranks or electronically-powered winches.

The invention is further directed to a utility vehicle coupled to such an advantageous hoist system.

BRIEF DESCRIPTION OF THE DRAWINGS

The drawings described below are for illustrative purposes only and are not intended to limit the scope of the invention.

DETAILED DESCRIPTION

Figure 1:
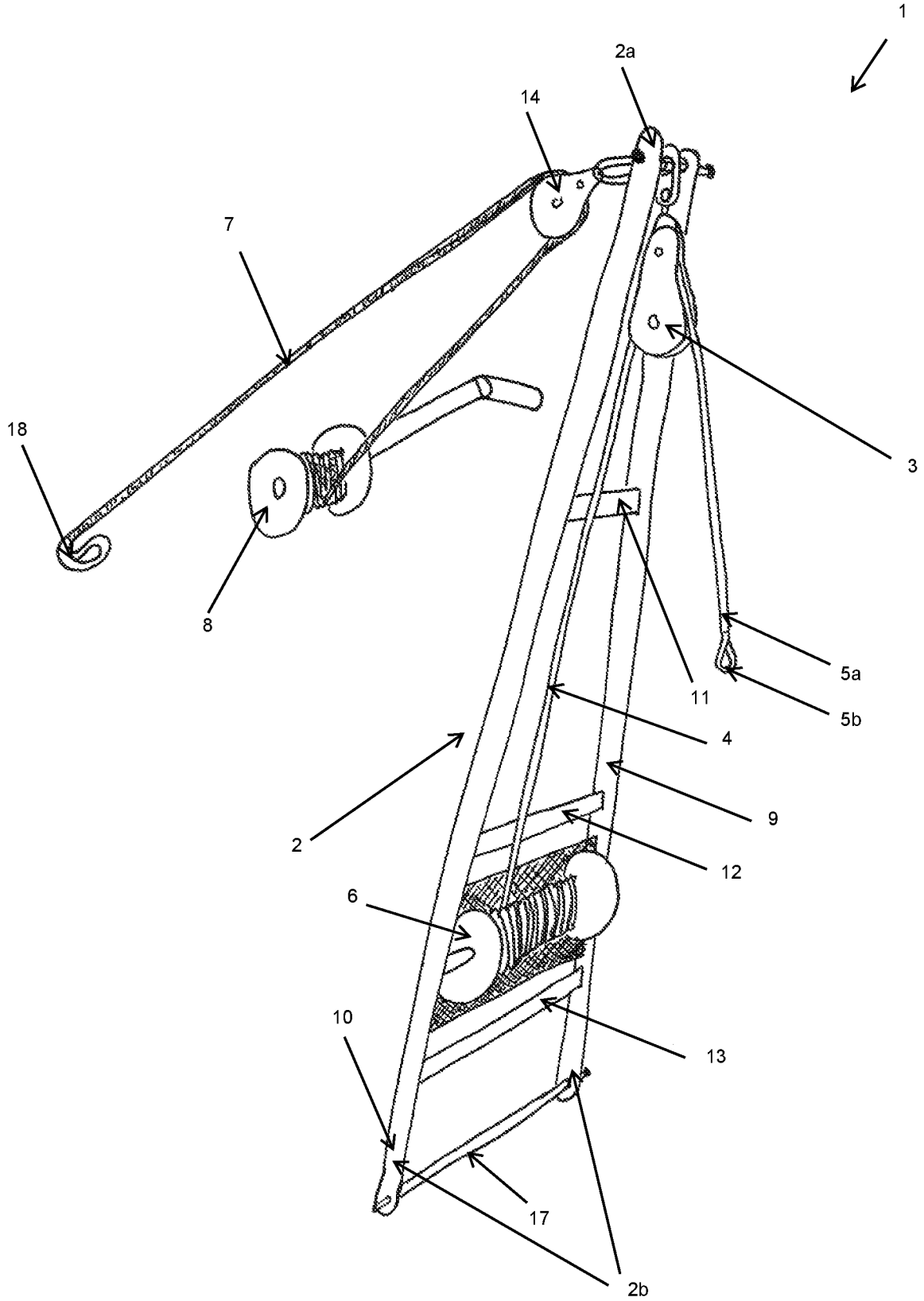
FIG. 1 depicts a representative hoist system according to a first embodiment of the invention.

It is to be understood that the terminology employed herein is for the purpose of describing particular embodiments, and is not intended to be limiting. Further, although any methods, devices and materials similar or equivalent to those described herein can be used in the practice or testing of the invention, certain methods, devices and materials are now described.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosure is further illustrated by the following descriptions, which are not to be construed as limiting this disclosure in scope or spirit to the specific procedures herein described. It is to be understood that the descriptions are provided to illustrate certain embodiments and that no limitation to the scope of the disclosure is intended thereby. It is to be further understood that resort may be had to various other embodiments, modifications, and equivalents thereof which may suggest themselves to those skilled in the art without departing from the spirit of the present disclosure and/or scope of the appended claims.

In describing the invention, it will be understood that a number of features, techniques and steps are disclosed. Each of these has individual benefit and each can also be used in conjunction with one or more, or in some cases all, of the other disclosed features, techniques and steps. Accordingly, for the sake of clarity, this description will refrain from repeating every possible combination of the individual features, techniques and steps in an unnecessary fashion. Nevertheless, the specification and claims should be read with the understanding that such combinations are entirely within the scope of the invention and the claims.

Definitions

The articles "a" and "an" are used in this disclosure to refer to one or more than one (i.e., to at least one) of the grammatical object of the article.

As used herein:

a. a "cable" may be a string, cord, single or multi-strand wire, rope, chain, belt or any similar object; and b. a "utility vehicle" means any of a UTV, ATV or golf cart or other larger utility vehicles such as pickup trucks or flatbed trucks or the like.

The disclosed hoist system advantageously transforms a utility vehicle into a lifting and transportation system which can rapidly lift and transport a heavy object over a multitude of landscapes without the need of separate equipment to place the object in a bed of the utility vehicle. A suitable utility vehicle for use with the hoist system includes, for example, a Kubota Model 400. The disclosed hoist system provides a compact light-weight design which can easily be stowed away and easily mounted to utility vehicle when needed. Further, the disclosed hoist system does not take up much of space, whether mounted (in upright position) or stored.

The disclosed hoist system when attached to a utility vehicle provides exceptional maneuverability in small, hard-to-reach places where a normal hoist or truck with hoist attachment would not easily fit, such as dense forests or between buildings which are close together. The hoist arm structure is pivotally moveable relative to an attachment location of the utility vehicle in height and extension length and thus allows maximum adaptability for a wide variety of load pickups. By adapting lighter utility vehicles, the inventions allows for users to minimize damage to grass and yard, especially when compared to hoists or skid-steers which have a heavy impact on the ground.

The invention is suitable for performing land maintenance, lifting and transporting boulders, tree, and debris. An additional benefit is the ability to drive the utility vehicle up onto a trailer to drop a load. The invention is helpful to many different groups of people. For instance, homeowners may use the invention to lift and transport wellheads, fence posts, and boulders. Landscapers may use the invention to lift and transport trees or debris as well as for loading equipment. Golf courses, resorts, large apartment complexes may use the invention in general maintenance of the property, for example, lifting and transporting fallen trees, or large items such as free-standing fire-pits, garbage disposals, outdoor furniture, and the like.

In exemplary embodiments, a bumper winch may be included on the utility vehicle, mounted proximate a front or rear bumper, or can be used with the hoist system.

The hoist system may be attached to the utility vehicle at an attachment location. The attachment location may be a receiver mount, an accessory mount or a location of the frame that accepts such attachment, which advantageously may be proximate the front or rear of the utility vehicle. The utility vehicle suitable for use with the present invention may comprise a receiver mount system which can include, for example and ease of illustration, a plow or pin slide and lock system. Thus, the disclosed hoist system can be mounted to a utility vehicle's pre-existing receiver mount.

For efficiency, applicant is not including within this application many aspects related to the present invention that would be known to a person of ordinary skill in the art.

Figure 2:
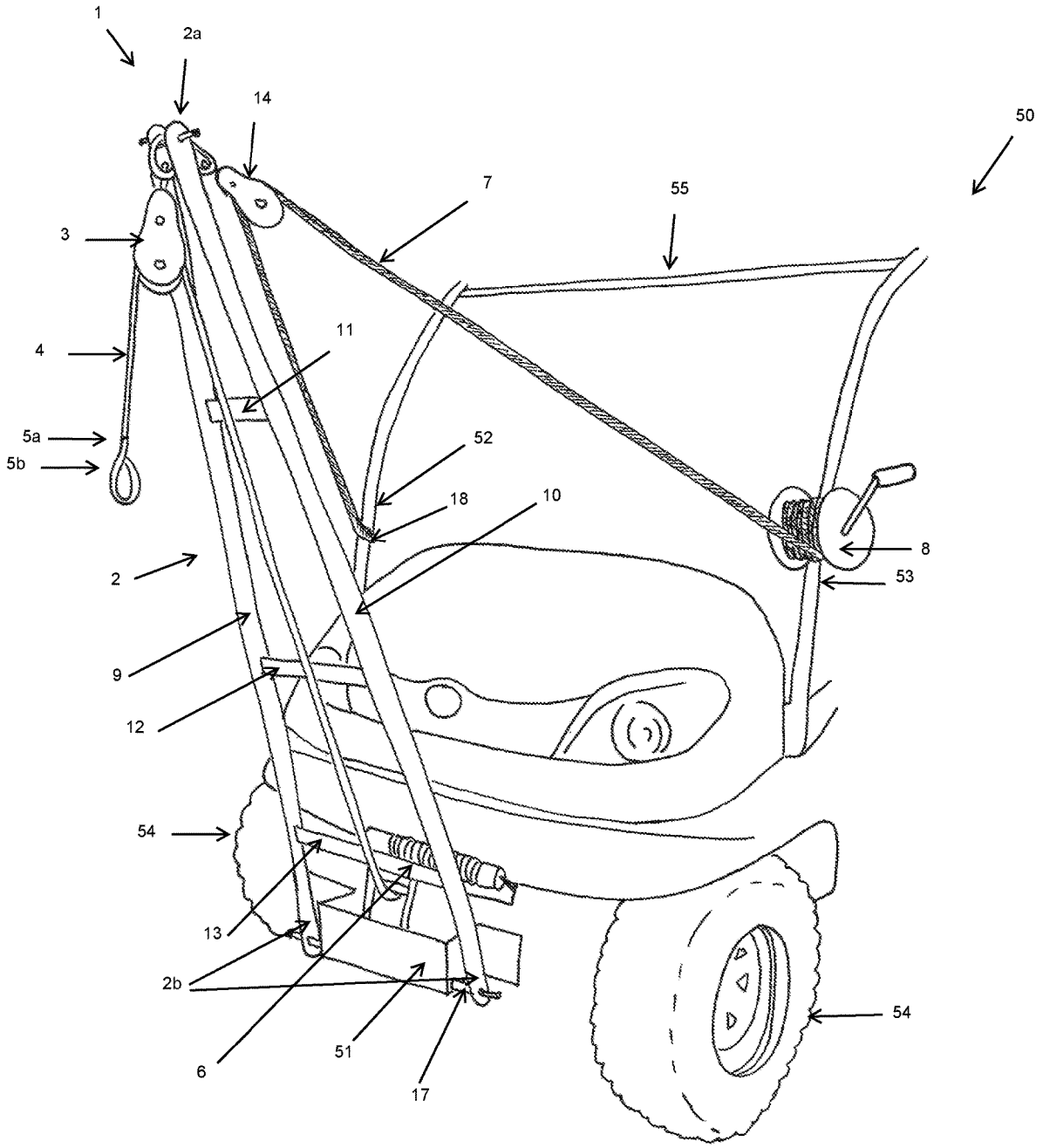
FIG. 2 depicts an exemplary hoist system coupled to a representative front attachment location of a utility vehicle in accordance with a second embodiment of the invention.
Figure 3:
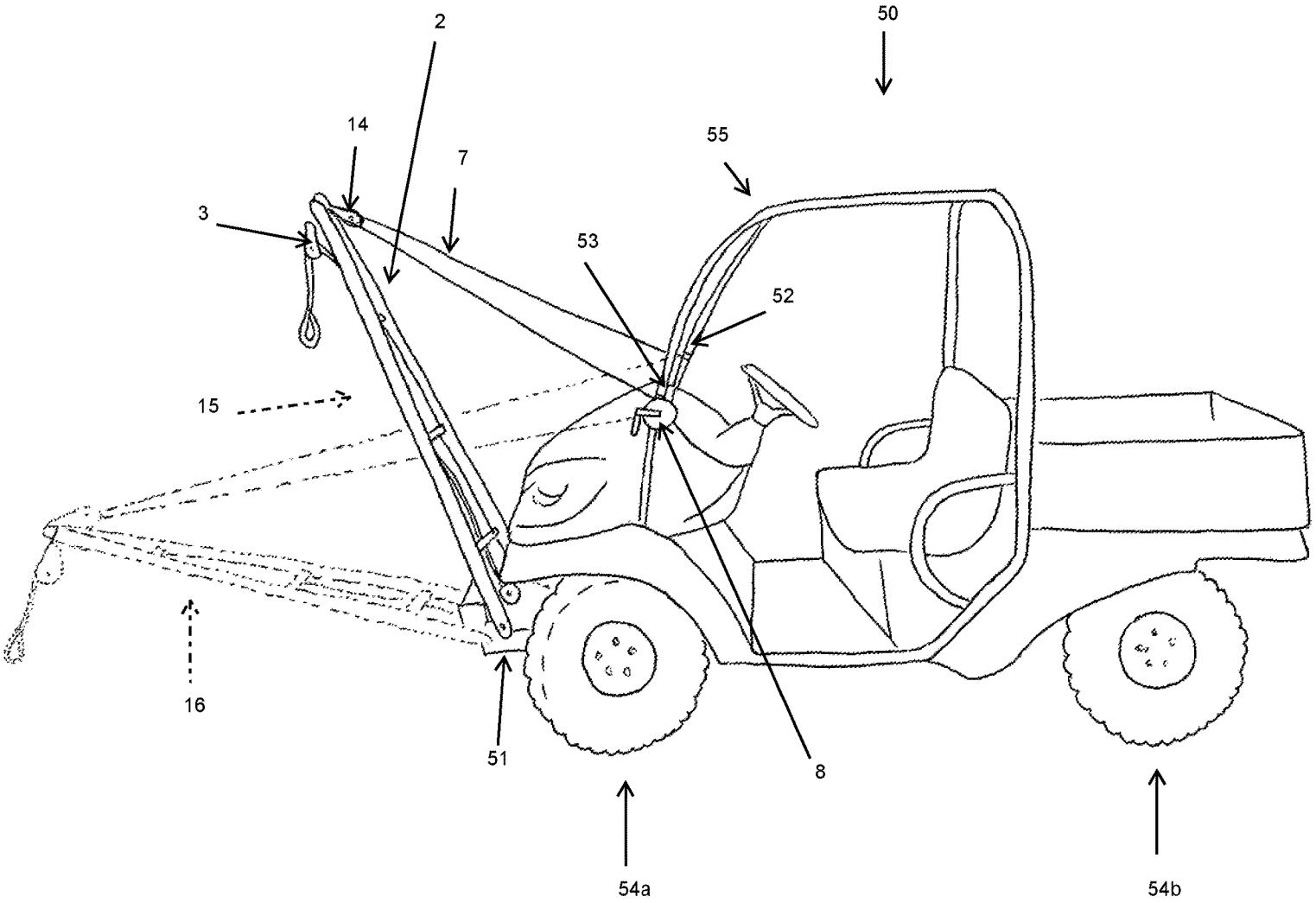
FIG. 3 depicts a side view of the exemplary hoist system coupled to the utility vehicle of FIG. 2.

FIG. 1 depicts an exemplary embodiment of hoist system 1. FIGS. 2 and 3 depict different views of an exemplary embodiment of hoist system 1 releasably mounted to a representative utility vehicle 50. Hoist system 1 includes hoist arm structure 2 having a top end 2*a* and a bottom end 2*b*. Mounting element 17 is pivotably attached to the bottom end 2*b* and is capable of being releasably attachable to an attachment location, such as, for example the depicted receiver mount 51 of a utility vehicle 50 as depicted in FIG. 2. This configuration allows the hoist arm structure 2 to pivotally move relative to the attachment element 17 thereby enabling the hoist arm structure to move up to at or near a vertical orientation, and down to at approximately a horizontal orientation.

The hoist system 1 includes an adjustment winch 8 with an adjustment cable 7 extending therefrom. The adjustment cable has a distal end 18 adapted for securing to a location of a first structural element 52 on a first lateral side of utility vehicle 50. The adjustment winch 8 is adapted for securing to a location of a second structural element 53 of utility vehicle 50 on a second lateral side of the utility vehicle opposite said first lateral side. The first structural element 52 and second structural element 53 are respective structural members of a structural frame system such as, but not limited to, roll cage 55. However, such structural members may be, for example, portions, extensions or link members or other elements of a structural frame system of a frame, roll cage, unibody, or hybrid unibody and frame configuration.

In the depicted embodiment of FIG. 2, the adjustment cable 7 may be threaded through a first pulley 14. This first pulley 14 may be rotatably mounted to a first location proximate top end 2*a* of hoist arm structure 2, and first pulley 14. For ease of illustration, the hoist arm structure 2 is depicted with two adjacent support members 9 and 10 with associated lateral and/or cross support structures 11, 12 and 13. However, the hoist arm structure 2 may have a larger or lesser number of adjacent support members, or have two stage configuration with for example, different support members for respective portions, e.g., top and bottom, or top, middle, and bottom of the hoist arm structure 2.

A second pulley 3 rotatably mounted to a second location proximate top end 2*a* of hoist arm structure 2 for receiving a hoist cable 4. The hoist cable 4 has a terminal end 5*a* which may include an attachment 5*b* such, for example, a hook for grapple attachments, straps, log-pinchers, engine blocks, and the like, for attaching to an object to moved. The hoist cable 4 is secured to and capable of being wound around rotatable arm medium 6 by a mechanical winch or manual crank.

Referring to FIG. 3, the adjustment winch's 8 and adjustment cable distal end's 7 attachment to the first and second structural elements 52 and 53 advantageously enables adjustment of a load closer to or away from the utility vehicle 50 to corresponding adjust the effective location of the center of gravity of the combination of the utility vehicle 50, hoist system 1 and a load (not shown) lifted off the ground by such hoist system 1. In this manner, such adjusted center of gravity may be beneficially maintained in a safe location between front and rear wheels for safe transportation of the load by the utility vehicle 50. In particular, FIG. 3 depicts the hoist arm structure 2 in (shadow-lined) relatively lowered position 15 for ease in accessing and initially lifting a load alone or in combination with the extension or retraction of the hoist cable 4. FIG. 3 also depicts the hoist arm structure in a relatively raised position 15 that would facilitate transportation of a load relative to the position 16. It should be readily understood that the hoist arm structure 2 in position any location in an arc formed between a highest and lowest position, wherein the position 15 and position 16 are included along such arc.

Is advantageous for the hoist arm structure to have a length between its top end and bottom end in the range of approximately 5 to 10 feet, but can be larger or smaller depending upon the needed application.

In operation, the cable 7, the top 2*a* of the hoist arm structure 2 will be higher off the ground and thus more perpendicular to the ground. This moves the effective center of gravity of the combination of the raised object, hoist system 1, and utility vehicle 50 closer to the actual center of gravity of the utility vehicle 50.

It is advantageous for the location of the first structural element and the location of second structural element of the utility vehicle are to be respective locations of a structural frame system of the utility vehicle no higher than a midpoint between highest and lowest points of the structural frame system. Further, in order to take extensive advantage of the hoist system of the present invention, it is desirable for the utility vehicle 50 to have an engine or motor (not shown) disposed at location proximate wheels at a first end of the utility vehicle, with the attachment location (to which the hoist system 1 is attached) disposed at location proximate wheels at a second or opposite end of the utility vehicle.

Figure 4:
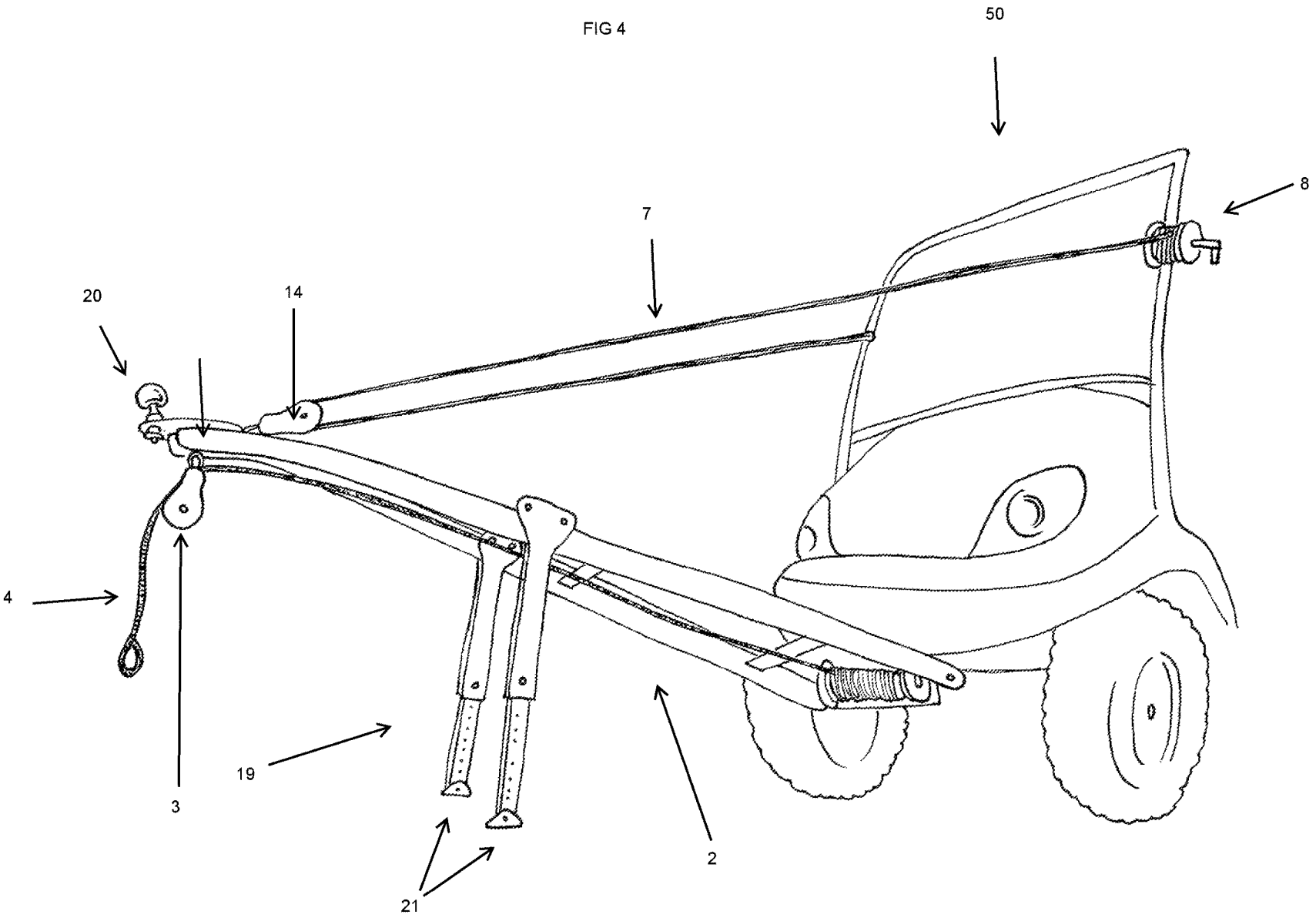
FIG. 4 depicts an exemplary hoist system coupled to a representative front attachment location of utility vehicle in accordance with a third embodiment of the invention.
Figure 5:
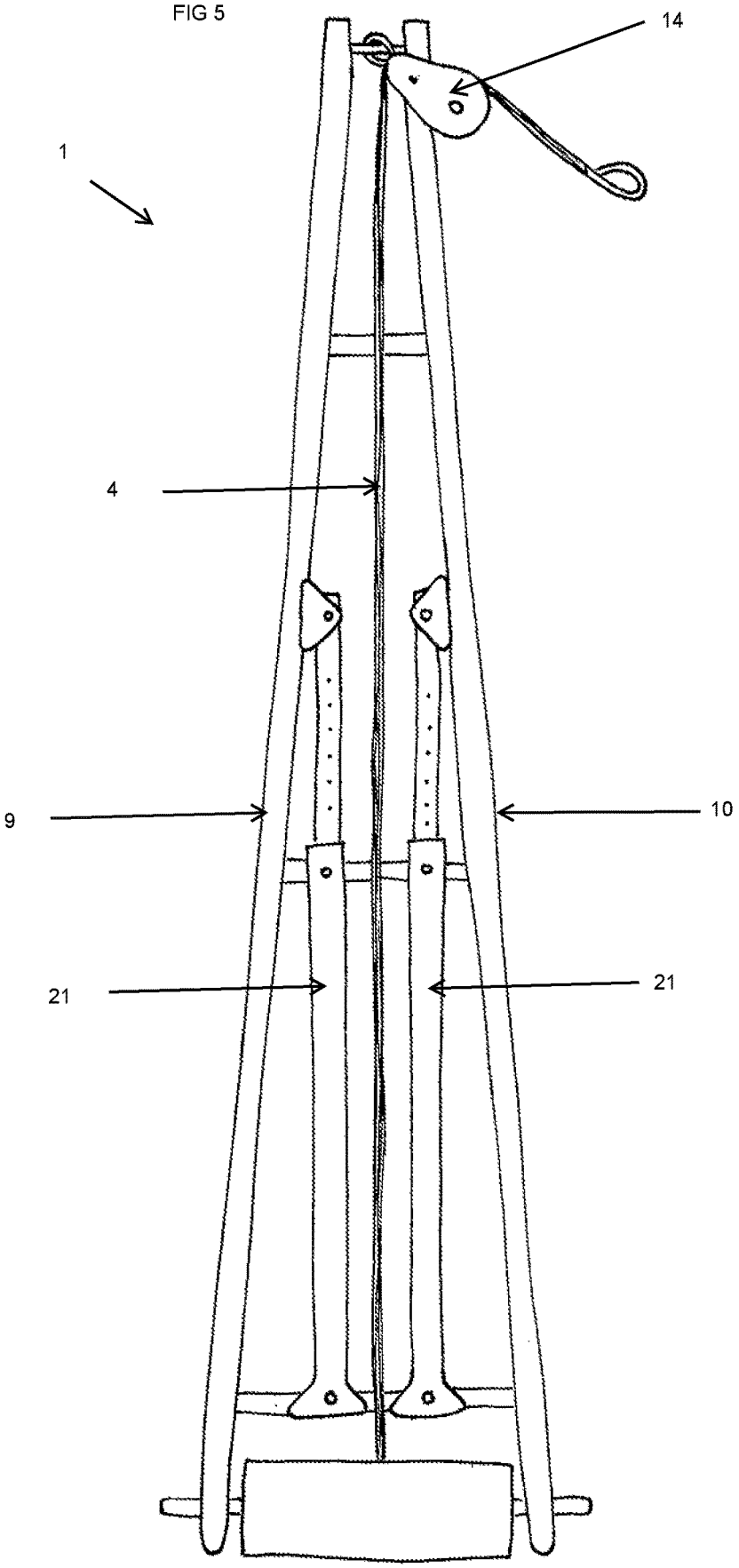
FIG. 5 depicts an exemplary hoist system in accordance with a fourth embodiment of the invention.

In an alternative embodiment depicted in FIG. 4, hoist system 1 includes a secondary support element 19 having a first end attached to the hoist arm structure 2 and a second end for contacting a surface such as the ground to provide "kickstand"-like functionality. Also, in FIG. 4, an optional hitch ball 20 is mounted to the hoist arm structure 2 proximate its top end 2*a*. In this embodiment, secondary support element 19 is coupled to adjacent support members 9 and 10. Lastly, a light pole (not shown) may have a bottom end mountable to the hoist arm structure 2 proximate its top end 2*a*. Such a light pole may have a light fixture located proximate a top end of such a light pole.

The secondary support element 19 may be removably attached to the hoist arm structure 2 such that it can be removed, if desired, when not needed. The secondary support element 19 include two legs elements 21, but one or a larger number may be used in accordance with the invention. The depicted leg elements 21 include telescoping, height-adjustable components enabling the end of secondary support element 19 opposite the hoist arm structure 2 to contact a surface thereby providing additional support for hoist system 1, for safely increasing the weight of objects to be lifted by the hoist system 1.

The secondary support element 19 may alternatively be retractable and lockable at a number of angles relative to the hoist arm structure 2. For instance, it may be capable of being rotated such that it is perpendicular to the hoist arm structure or approximately parallel to the hoist arm structure. Additionally, the secondary support element 19 may be locked into other positions to additional support as needed or locked into a stowed retracted position stowing. In another embodiment, the secondary support element 19 may be locked into an advantageous position to provide fork-lift functionality for lifting and moving pallets and the like.

The secondary support element 19 may additionally be detached from the hoist arm structure 2 and re-mounted at different locations along the hoist arm structure 19 for greater utility.

FIG. 4 further shows the optional hitch ball mount 20 proximate to the top end 2*a* of hoist arm structure 2. When the hoist arm structure 2 is at a position approximately parallel to the ground, the utility vehicle 50 may tow items attached to the hitch ball 20.

In yet another embodiment, a light pole (not shown) may be mounted proximate the top end 2*a* of the hoist arm structure 2. This light would include at least one light fixture for mobile lighting functionality.

In a further embodiment, the hoist arm structure 2 may be coupled to a bucket or a hunting stand to provide yet further functionality.

It is to be understood that the invention is not limited to the particular embodiments of the invention described above, as variations of the particular embodiments may be made and still fall within the scope of the appended claims.

The invention claimed is:

1. A hoist system comprising:

a hoist system releasably attached to a utility vehicle;

the hoist system comprising:

a hoist arm structure having top and bottom ends, an attachment element adapted to releasable attach the bottom end of the hoist arm structure to an attachment location of the utility vehicle whereby the hoist arm is able to pivot relative to said attachment location;

an adjustment winch having an adjustment cable extending therefrom, said adjustment cable having a distal end, wherein the distal end of the adjustment cable is adapted for securing to a location of a first structural element on a first lateral side of the utility vehicle, and the adjustment winch is adapted to for securing to a location of a second structural element on a second lateral side of the utility vehicle opposite said first lateral side, and wherein the first structural element location and the second structural element location of the utility vehicle are respective locations of a structural frame system of the utility vehicle no higher than a midpoint between highest and lowest points of the structural frame system;

a first pulley rotatably mounted to a first location proximate the top end of the hoist structure, said first pulley adapted to receive the adjustment cable;

a second pulley rotatably mounted to a second location proximate the top of the hoist arm structure for receiving a hoist cable, said hoist cable having a terminal end for coupling to an object to be moved wherein the hoist cable has a proximal end adapted for coupling to a hoist winch, wherein for raising a coupled object the hoist winch is operated to retract a relative portion of the hoist cable, and for lowering a coupled object the hoist winch is operated to extend a relative portion of the hoist cable; and wherein when the adjustment winch is operated to retract a relative portion of the adjustment cable, the hoist arm structure is pivotally raised relative to the attachment location and wherein when the adjustment winch is operated to extend the adjustment cable the hoist arm structure is pivotally lowered relative to the attachment location.

2. The hoist system of claim 1, wherein the hoist winch is attached to the hoist arm structure at a location between the top and bottom ends.

3. The hoist system of claim 1, wherein the hoist winch is attached to the utility vehicle.

4. The hoist system of claim 1, wherein the structural frame system of the utility vehicle is a roll cage.

5. The hoist system of claim 1, wherein the hoist arm structure comprises two adjacent support members coupled to one another, wherein a separation distance between the support structures is larger proximate the bottom end relative to the top end.

6. The hoist system of claim 1, wherein the adjacent support members are coupled to one another by at least one lateral support member.

7. The hoist system of claim 1, wherein the adjustment winch is a ratchet and pawl crank that locks in one direction.

8. The hoist system of claim 7, wherein the adjustment winch further comprises a manual crank.

9. The hoist system of claim 1, wherein the adjustment winch is an electronically-actuated motorized winch.

10. The hoist system of claim 1, wherein the terminal end of the hoist cable comprises coupling element adapted for attachment to the object to be moved.

11. The hoist system of claim 1, wherein the utility vehicle comprise one of a utility-task vehicle or all-terrain vehicle.

12. The hoist system of claim 1, wherein the utility vehicle has an engine disposed at location proximate wheels at a first end of the utility vehicle, with the attachment location disposed at location proximate wheels at a second end of the utility vehicle.

13. The hoist system of claim 1, further comprising a hitch ball mountable proximate to the top end of the hoist mount.

14. A hoist system, comprising:

a hoist system releasably attached to a utility vehicle;

the hoist system comprising:

a hoist arm structure having top and bottom ends, an attachment element adapted to releasable attach the bottom end of the hoist arm structure to an attachment location of the utility vehicle whereby the hoist arm is able to pivot relative to said attachment location;

an adjustment winch having an adjustment cable extending therefrom, said adjustment cable having a distal end, wherein the distal end of the adjustment cable is adapted for securing to a location of a first structural element on a first lateral side of the utility vehicle, and wherein the adjustment winch is adapted to for securing to a location of a second structural element on a second lateral side of the utility vehicle opposite said first lateral side;

a first pulley rotatably mounted to a first location proximate the top end of the hoist structure, said first pulley adapted to receive the adjustment cable;

a second pulley rotatably mounted to a second location proximate the top of the hoist arm structure for receiving a hoist cable, said hoist cable having a terminal end for coupling to an object to be moved, wherein when the adjustment winch is operated to retract a relative portion of the adjustment cable, the hoist arm structure is pivotally raised relative to the attachment location and when the adjustment winch is operated to extend the adjustment cable the hoist arm structure is pivotally lowered relative to the attachment location; and a secondary support element the secondary support element having a first end attachable to the hoist arm structure, and a second end capable of contacting a surface proximate the utility vehicle, wherein the secondary support element is attachable to the hoist arm structure at different locations of the hoist arm structure.

15. The hoist system of claim 14, wherein the secondary support element is at least one of: rigidly attachable to the hoist arm structure, height adjustable, stowable in a retracted position relative to the hoist arm structure, or attachable to the hoist arm structure at a plurality of angular positions relative to at least a portion of the hoist arm structure.

* * * * *